United States Patent [19]

Kamp

[11] 4,362,198

[45] Dec. 7, 1982

[54] CLOSURE DEVICE

[75] Inventor: Ewald A. Kamp, Chicago, Ill.

[73] Assignee: Union Carbide Corporation, Danbury, Conn.

[21] Appl. No.: 134,167

[22] Filed: Mar. 26, 1980

Related U.S. Application Data

[62] Division of Ser. No. 892,432, Mar. 31, 1978, Pat. No. 4,212,337.

[51] Int. Cl.[3] ..... B65D 33/30

[52] U.S. Cl. ..... 150/3

[58] Field of Search ..... 150/3; 24/201 C; 215/DIG. 1

[56] References Cited

U.S. PATENT DOCUMENTS

| | | | |
|---|---|---|---|
| Re. 28,969 | 9/1976 | Naito | 150/3 |
| 2,637,085 | 5/1953 | Madsen | 24/201 C |
| 3,255,909 | 6/1966 | Miller et al. | 215/DIG. 1 |
| 3,685,562 | 8/1972 | Ausnit | 150/3 |
| 3,780,781 | 12/1973 | Uramoto | 150/3 |
| 4,212,337 | 7/1980 | Kamp | 150/3 |

FOREIGN PATENT DOCUMENTS

| | | |
|---|---|---|
| 540561 | 5/1957 | Canada . |
| 761154 | 6/1967 | Canada . |
| 777454 | 2/1968 | Canada . |
| 812089 | 5/1969 | Canada . |
| 1303425 | 4/1967 | Fed. Rep. of Germany . |
| 2554392 | 10/1976 | Fed. Rep. of Germany . |
| 1511925 | 7/1977 | Fed. Rep. of Germany . |
| 1611935 | 12/1978 | Fed. Rep. of Germany . |
| 1204546 | 1/1960 | France . |
| 1092453 | 11/1964 | United Kingdom . |
| 1307672 | 4/1970 | United Kingdom . |

*Primary Examiner*—Stephen P. Garbe

*Attorney, Agent, or Firm*—Real J. Grandmaison; John C. Lefever; Harrie M. Humphreys

[57] ABSTRACT

A closure fastening device comprises a first channel element including hook portions facing away from each other and a second channel element including hook portions facing towards each other, whereby the channel elements interlock by pressing the first channel element into the second channel element so that the hook portions engage each other at predetermined contact surfaces. The closure fastening device can be connected to the opening of a container to form a container capable of being closed and opened.

22 Claims, 12 Drawing Figures

CLOSURE DEVICE

This application is a division of our prior U.S. application: Ser. No. 892,432, filing date Mar. 31, 1978, now U.S. Pat. No. 4,212,337.

The invention relates to a closure fastening device and more particularly to a closure fastening device including interlocking first and second channel elements suitable for use in connection with a container.

Generally, closure fastening devices for use in connection with plastic bags and the like are known. Furthermore, manufacturing methods for closure fastening devices made of plastic material are generally well-known.

A closure fastening device for use in connection with a flexible container should be relatively easy to open from the outside, but relatively difficult to open from the inside. Generally, such a container can be used with its interior either under relatively high pressure or relatively under low pressure. The closure fastening device should provide a satisfactory seal for either condition.

Preferably, the closure fastening device should be suitable for economical manufacturing and should be relatively simple in design. In addition, the design should provide for variations in order to meet different needs. For example, it may be desirable to have a closure fastening device which is relatively difficult to open both from the inside and the outside. In general, the closure fastening device, however, should always be relatively easy to close.

The foregoing criteria for a closure fastening device are met by one embodiment of the present invention which embodiment comprises a first channel element including a first base portion, a pair of spaced apart first webs extending from the first base portion, and first hook portions extending from each of the first webs and facing away from each other; and a second channel element including a second base portion, a pair of spaced apart second webs extending from the second base portion, and second hook portions extending from each of the second webs and facing towards each other, the channel elements being adapted to interlock by pressing the first channel element into the second channel element so that the first and second hook portions engage at predetermined pairs of contact surfaces, one pair of the contact surfaces defining a negative angle of engagement, and the channel elements defining a compartment when the channel elements are interlocked.

Another embodiment of the invention is the aforementioned closure fastening device wherein the other pair of contact surfaces define a negative angle of engagement.

A further embodiment of the invention is the aforementioned closure fastening device wherein the other pair of contact surfaces define a positive angle of engagement.

Another further embodiment of the invention is the aforementioned closure fastening device wherein the other pair of contact surfaces define a zero angle of engagement.

Another further embodiment of the invention is the aforementioned closure fastening device wherein the first base portion is resiliently bendable.

Another further embodiment of the invention is the aforementioned closure fastening device wherein the second base portion is resiliently bendable.

A still further embodiment of the invention is a container including the aforementioned closure fastening device.

The invention accordingly comprises the features of construction, combination of elements and arrangement of parts which will be exemplified in a construction hereinafter set forth and the scope of the application of which will be indicated in the claims.

Generally, the closure fastening device of the invention can be made from polyethylene, polypropylene, nylon, or another thermoplastic material or the like or a combination thereof. The dimensions of the closure device would vary in accordance with the technology depending upon the materials used because of the variation in physical properties such as moduli.

The closure fastening device of the invention can be manufactured by extrusion, or by the use of molds or other known methods of producing such devices. The closure fastening device can be manufactured as a strip for later attachment to a film or it can be manufactured integral with the film. In addition, the closure device can be manufactured with or without flanges on one or both of the channel elements depending upon intended use or expected additional manufacturing operations. The use of a relatively thin cross-sectional profile for each of the channel elements provides the advantage that the interlocked channel elements can be cut and sealed by the use of heat without very much physical distortion at the ends. The compartment formed by the interlocked channels allows for an easy and reliable sever seal because of the reduced cross-sectional density.

The channel elements can be connected to a container or to a film to be formed into a container by the use of one of many known methods. A thermoelectric device can be applied to a film opposite a channel element to cause a transfer of heat through the film to produce melting at the interface of the film and the channel element. After cooling, the interface region joins the film and the channel element.

The thermoelectric device can be heated rotary discs, or resistance heated slide wires or travelling heater bands or the like.

The connection between the film and the channel element can also be established by the use of hot melt adhesives, or hot jets of air to the interface, or ultrasonic heating or other known methods.

Generally, the present closure device can be made from a heat sealable material and then attached to a heat sealable film so that a container can be formed economically by heat sealing surfaces to form the container.

The present closure fastening device provides many advantages for use in containers to be used by consumers. For example, the closure device is easy to close and does not tend to twist and distort during occlusion as in the case of some prior art devices. This provides convenience in the closing operation.

The closure fastening device also provides the advantage of an approximately uniform cross-section. This not only simplifies the manufacturing of the device but it also contributes to the physical flexiblity of the device which is a desireable property.

For a fuller understanding of the nature and objects of the invention, reference should be had to the following detailed description, taken in connection with the accompanying drawings, in which.

Figure 6A:
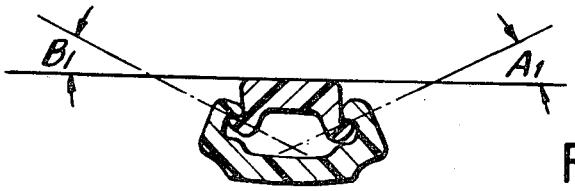
Figure 6B:
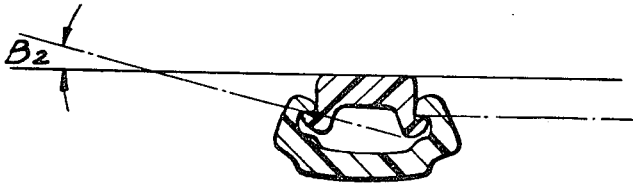
Figure 6C:
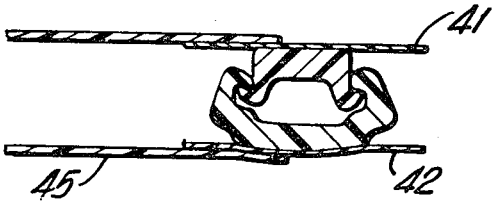
Figure 7:
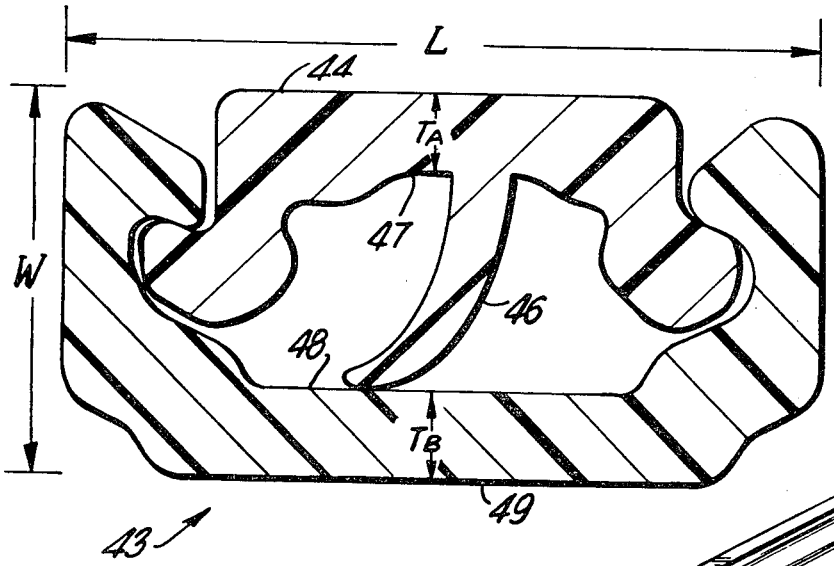
Figure 8:
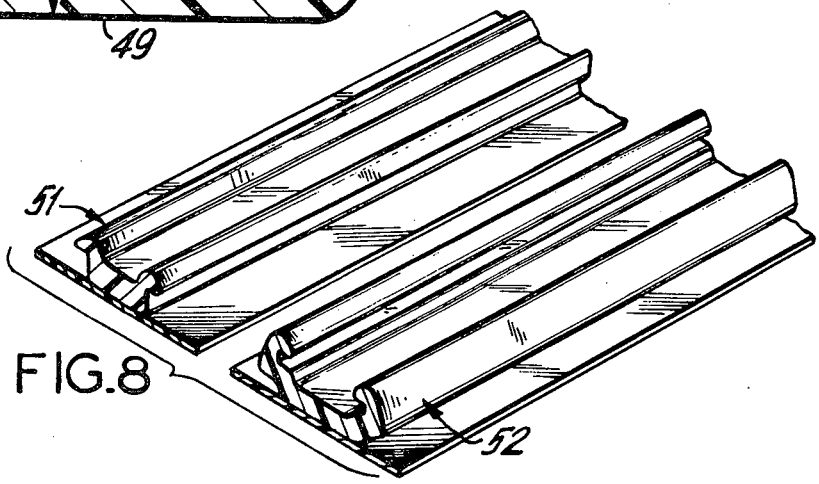
Figure 9:
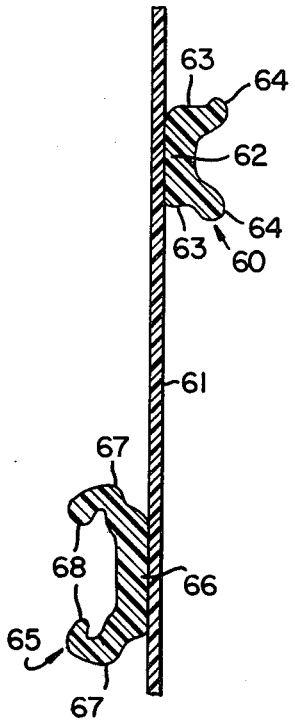
Figure 7A:
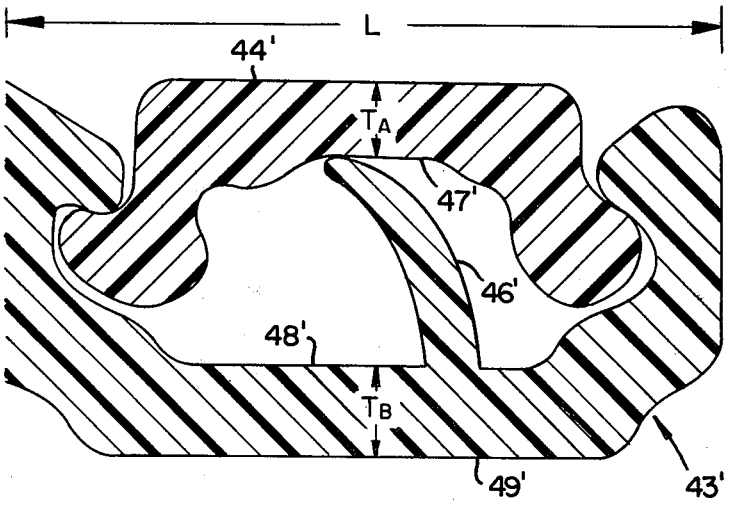

FIGS. 6A, 6B, and 6C show diagrammatic and sectional views of three embodiments of the invention;

FIG. 7 shows a diagrammatic and sectional view of a further embodiment of the invention;

FIG. 7A shows a diagrammatic and sectional view of still a further embodiment of the invention;

FIG. 8 shows a perspective view of a closure fastening device of the invention in the form of tapes or strips; and FIG. 9 shows a diagrammatic and sectional view of a further embodiment of the invention.

In carrying the invention into effect, certain embodiments have been selected for illustration in the accompanying drawings and for description in this specification, reference being had to FIGS. 1 to 8.

Figure 1:
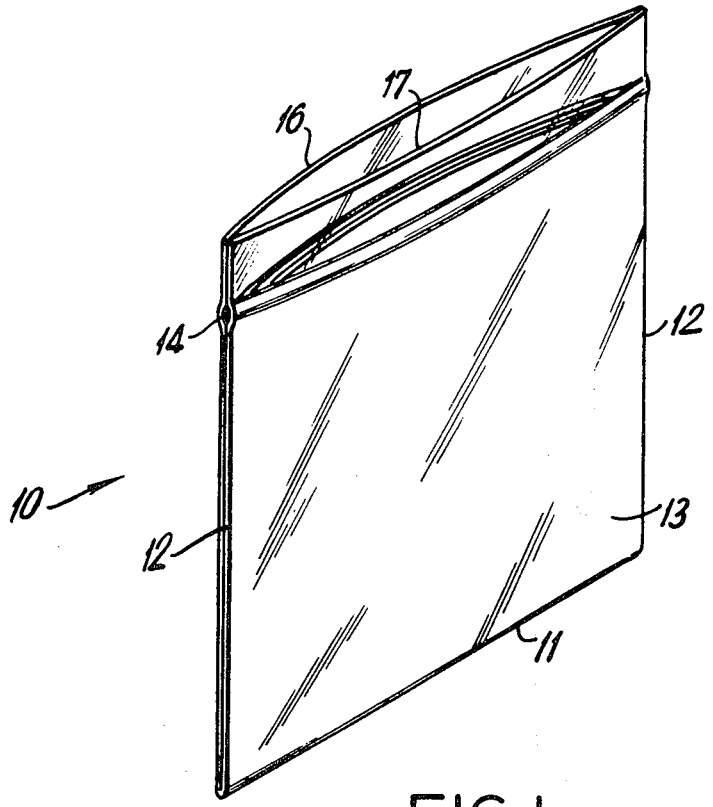
FIG. 1 is a perspective view of a flexible container including a closure fastening device in accordance with the invention.

FIG. 1 shows a typical flexible container 10 formed from a thin, plastic film which is folded at bottom portion 11 and is heat sealed along the vertical side edges 12 to form a pouch.

The sidewalls 13 extend beyond a closure fastening device 14 to provide mouth portions 16 and 17 to simplify the opening of the closure fastening device 14.

Figure 2:
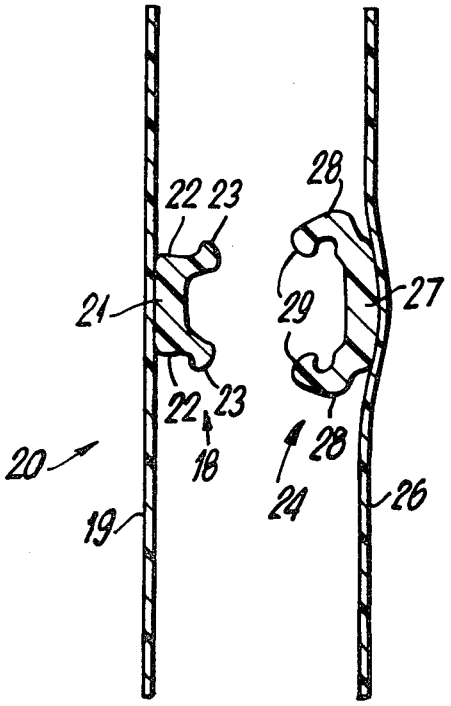
FIG. 2 shows a diagrammatic and sectional view of a portion of a container including one embodiment of an open closure fastening device in accordance with the invention.
Figure 3:
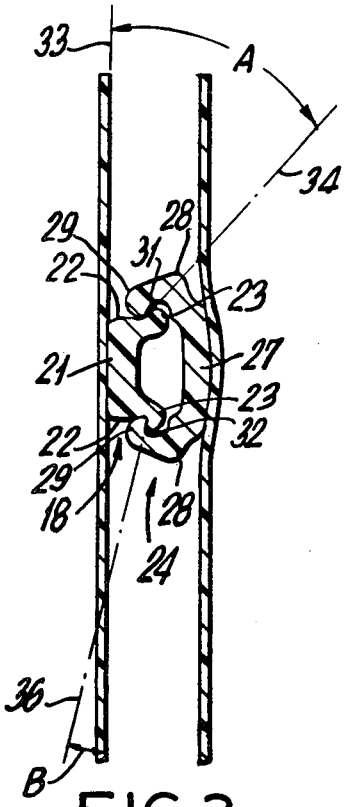
FIG. 3 shows a diagrammatic and sectional view of the closure fastening device of FIG. 2 in a closed position.

One embodiment of the invention is shown in the open and closed positions in FIGS. 2 and 3. A first channel element 18 is connected to a sidewall 19 of a container 20 and includes a first base portion 21, a pair of spaced apart first webs 22 extending in a generally normal direction from the first base portion 21, and first hook portions 23 extending from each of the first webs 22 and facing away from each other. A second channel element 24 is connected to sidewall 26 and includes a second base portion 27, a pair of spaced apart second webs 28 extending in a generally normal direction from the second base portion 27 and second hook portions 29 extending from each of second webs 28 and facing towards each other.

For FIGS. 2 and 3, the channel elements 18 and 24 were formed and were thereafter connected to a film which became the sidewalls 19 and 26.

The channel elements 18 and 24 are interlocked by pressing the first channel element 18 into the second channel element 24 so that the hook portions 23 and 29 engage at predetermined pairs of contact surfaces 31 and 32. During the interlocking of the channel elements 18 and 24, at least one of the base portions 21 and 27 flexes or the webs 22 and 28 flex or a combination of these parts flex to achieve an easy occlusion.

As used herein, the angle of engagement is the angle between a straight line approximately defined by the base portion of a first channel element, the male element, and a straight line approximately defined by the pair of contact surfaces of the engaged hook portions. In FIG. 3, the straight line defined by the first base portion 21 corresponds approximately to line 33 whereas line 34 is defined by the pair of contact surfaces of the engaged hook portions on one side of the closure fastening device.

As used herein, a positive angle of engagement occurs when the line defined by the pair of contact surfaces intersects the line defined by the first base portion on the side of the closure fastening device away from the reference pair of contact surfaces. In FIG. 3, the angle of engagement A is defined by lines 34 and 33 and is a positive angle of engagement.

As used herein, a negative angle of engagement occurs when the line defined by the pair of contact surfaces intersects the line defined by the first base portion on the same side of the closure fastening device as the reference pair of contact surfaces. In FIG. 3, the angle of engagement B is defined by lines 36 and 33 and is, therefore, a negative angle of engagement.

As used herein, a zero angle of engagement occurs when the line defined by the pair of contact surfaces intersects the line defined by the first base portion remotely and, ideally, if the two lines are parallel.

As can readily be realized, the force needed to disengage hook portions having a positive angle of engagement is generally less than the force necessary to disengage hook portions having a negative angle of engagement. Thus, the closure fastening device of FIG. 3 is characterized by being easier to open from the outside of the container 20 than it is from the inside of the container 20.

It is evident that generally the larger the negative angle of engagement, the greater the force necessary for disengagement of hook portions. Of course, the closure fastening device having a large negative angle of engagement on the inside of the container can be opened more easily if the angle of engagement for the hook portions on the outside container is zero or positive or even a small negative angle.

If at least one of the base portions 21 and 27 is flexible, it tends to enable the closure fastening device to be opened with relative ease. If both base portions are flexible a relatively large negative angle of engagement for each pair of hooks can be used.

Figure 4:
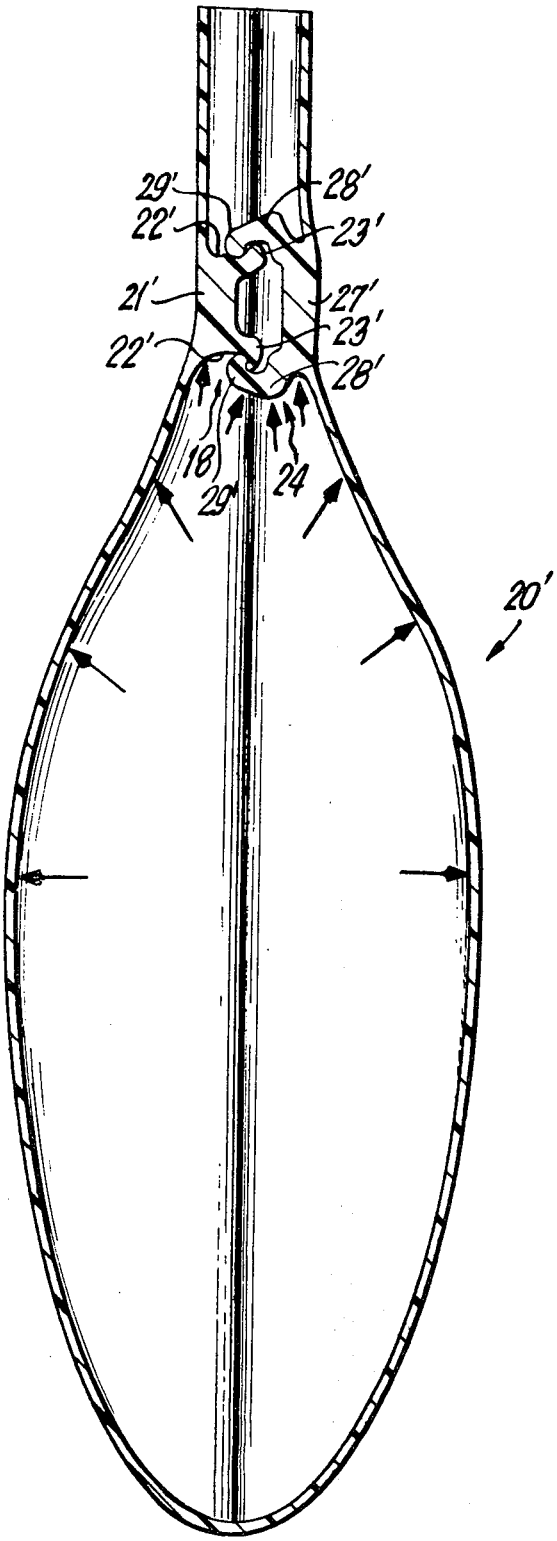
FIG. 4 shows a diagrammatic and sectional view of a flexible container including the closure fastening device of FIG. 2 with relatively high internal pressure for the container.
Figure 5:
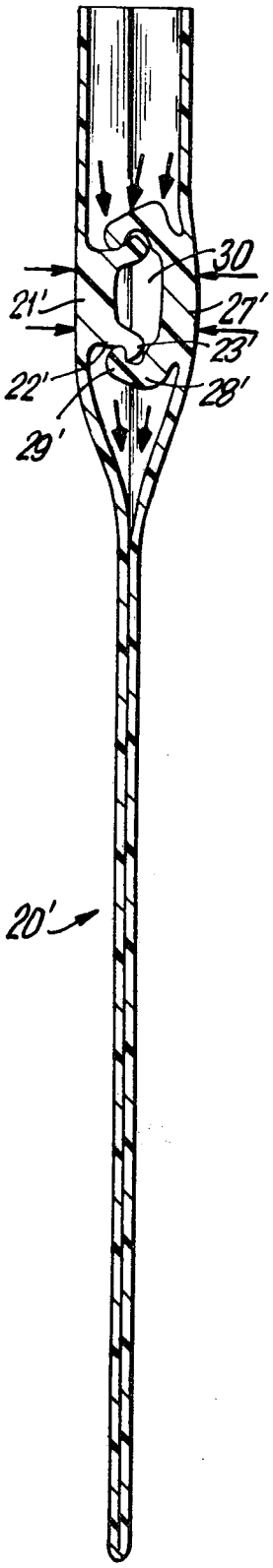
FIG. 5 shows a diagrammatic and sectional view of a flexible container including the closure fastening device of FIG. 2 with the container evacuated.

FIGS. 4 and 5 show a container 20′ in which channel elements 18′ and 24′ have been formed integral with a film rather than being connected as in the case of the container 20. The film including channel elements can be formed by known extrusion methods.

FIG. 4 shows a typical container 20′ having relatively high internal pressure as indicated by the arrows. The forces on the channel elements 18′ and 24′ are shown by arrows. The forces on the inside of the container 20′ tend to press the webs 22′ and 28′ together while at the same time the channel elements 18′ and 24′ tend to be pulled apart so that the hook portions 23′ and 29′ tend to engage more tightly together and thereby maintain a tight seal of the closure fastening device.

FIG. 5 shows the container 20′ under low pressure or evacuated condition. Again, the forces around the channel elements 18′ and 24′ are indicated by arrows. It is expected that some leakage will occur between the contact surfaces near the inside of the container 20′ so that a reduced pressure will be present in the compartment 30 and forces will be present on the outside surfaces of base portions 21′ and 27′ and at hook portion 29′ as indicated by the arrows.

The FIGS. 6A, 6B, and 6C show three additional embodiments of the invention. FIG. 6A shows a closure device in which both angles of engagement, $A_1$ and $B_1$ are negative angles. FIG. 6B shows a closure fastening device in which the angle $B_2$ is a negative angle whereas the other angle of engagement is approximately a zero angle. The zero angle of engagement enables an easy opening and is preferable for the outside of a container.

FIG. 6C shows a closure fastening device similar to that of FIG. 6A with flanges 41 and 42 for mounting the closure fastening device easily on a film 45 to be formed into a container or onto a container lip portion or the like.

FIG. 7 shows an additional embodiment of the invention featuring a spring element for maintaining an improved seal for relatively high pressure from the left side of the closure fastening device.

The closure fastening device 43 includes a first channel element 44 having a spring element 46 extending from the base portion 47 to the base portion 48 of the second channel element 49. The spring element 46 for relatively high pressure from the left side of the closure fastening device 43 would be urged towards the base portion 48 and thereby tend to increase the sealing action by providing a second seal.

The spring element 46 would preferably be bent in the opposite direction for use in connection with a container to be evacuated. Such a closure fastening device would be advantageous for so-called "home canning" by consumers.

The typical physical dimensions of a closure fastening device of the invention with reference to FIG. 7 is as follows:

1. $T_A$ is from about 0.012 to about 0.030 inch;
2. $T_B$ is from about 0.012 to about 0.030 inch;
3. W is from about 0.040 to about 0.080 inch;
4. L is from about 0.080 to about 0.150 inch.

FIG. 7A shows an additional embodiment of the invention featuring a spring element for maintaining an improved seal. The closure fastening device 43' includes a first channel element 44' having a base portion 47' and a second channel element 49' having a spring element 46' extending from the base portion 48' of the second channel element 49'.

FIG. 8 shows a perspective view of the tape or strip form of the invention with flanges. As shown the channel elements 51 and 52 are attached to the base tapes 53 and 55; however, it is to be understood that the channel element and base tape can be formed integrally similar to the integrally formed closure and bag film of FIGS. 4 and 5.

In addition to use with a container, the closure fastening device can be used to electrically insulate wire leads or bind together a group of wires. The closure device can also be used as a flexible straw because a good seal at the engaged surface is possible and the compartment defined by the elements provides a passageway which does not collapse when the closure fastening device is bent.

Generally, the closure device of the invention can be manufactured in a variety of forms to suit the intended use. In addition to the embodiments shown in FIGS. 4 and 5, the elements can be positioned on opposite sides of a film as shown in FIG. 9. A first channel element 60 is connected to a film 61 and includes a first base portion 62, a pair of spaced apart first webs 63 extending in a generally normal direction from the first base portion 62, and first hook portions 64 extending from each of the first webs 63 and facing away from each other. A second channel element 65 is connected on the opposite side of film 61 and offset from the first channel element. The second channel element includes a second base portion 66, a pair of spaced apart second webs 67 extending in a generally normal direction from the second base portion 66 and second hook portions 68 extending from each of second webs 67 and facing towards each other. Such an embodiment would be suited for enwrapping an object or a collection of objects such as wires. Generally, the elements on a film should be parallel to each other but this would depend on the intended use.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. A container including two sidewalls and a closure fastening device consisting essentially of:

a first u-shaped channel element including a first base portion having one side connected to one of said sidewalls, a pair of spaced apart first webs extending from said first base portion, and first hook portions extending from each of said first webs and facing away from each other;

and a second u-shaped channel element including a second base portion, a pair of spaced apart second webs extending from said second base portion having one side connected to the other sidewall, and second hook portions nonlinearly extending from each of said second webs and facing towards each other;

one of said channel elements further comprising a spring element extending from its base portion to the base portion of said second channel element when said channel elements are occluded;

said bases being of sufficient width to allow at least one of them to flex during the occlusion and opening of said fastening devices:

said channel elements being adapted to interlock by pressing said first channel element into said second channel element so that said first and said second hook portions engage at predetermined pairs of contact surfaces, one of said pairs of said contact surfaces defining a negative angle of engagement and the other of said pairs of said contact surfaces defining either a positive or a zero angle of engagement; and said channel elements establishing an open compartment defined by the interior surfaces of said first and second base portion and first and second web portion when said channel elements are occluded, each of said channel elements having substantially the same cross section along its occludable length.

2. The container of claim 1, wherein said spring element is connected to first channel element.

3. The container of claim 1, wherein said spring element is connected to second channel element.

4. A container including two sidewalls and a closure fastening device consisting essentially of:

a first u-shaped channel element including a first base portion having one side connected to one of said sidewalls, a pair of spaced apart first webs extending from said first base portion, and first hook portions extending from each of said first webs and facing away from each other; and a second u-shaped channel element including a second base portion, a pair of spaced apart second webs extending from said second base portion having one side connected to the other sidewall, and second hook portions nonlinearly extending from each of said second webs and facing towards each other;

one of said channel elements further comprising a spring element extending from its base portion to the other base portion when said channel elements are occluded;

said bases being of sufficient width to allow at least one of them to flex during the occlusion and opening of said fastening device:

said channel elements being adapted to interlock by pressing said first channel element into said second channel element so that said first and said second hook portions engage at predetermined pairs of contact surfaces defining a negative angle of engagement; and said channel elements establishing an open compartment defined by the interior surfaces of said first and second base portion and first and second web portion when said channel elements are occluded each of said channel elements having substantially the same cross section along its occludable length.

5. The container of claim 4, wherein said spring element is connected to first channel element.

6. The container of claim 5, wherein said spring element is connected to second channel element.

7. A closure fastening device consisting essentially of:

a first u-shaped channel element including a first base portion, a pair of spaced apart first webs extending from said first base portion, and first hook portions extending from each of said first webs and facing away from each other;

and a second u-shaped channel element including a second base portion, a pair of spaced apart second webs extending from said second base portion, and second hook portions nonlinearly extending from each of said second webs and facing towards each other;

said bases being of sufficient width to allow at least one of them to flex during the occlusion and opening of said fastening device;

said channel elements being adapted to interlock by pressing said first channel element into said second channel element so that said first and said second hook portions engage at predetermined pairs of contact surfaces, one of said pairs of said contact surfaces defining a negative angle of engagement and the other of said pairs of said contact surfaces defining either a positive or a zero angle of engagement; and said channel elements establishing an open compartment defined by the interior surfaces of said first and second base portion when said channel elements are occluded, each of said channel elements having substantially the same cross section along its occludable length.

8. The closure fastening device of claim 7, wherein said first base portion is resiliently bendable.

9. The closure fastening device of claim 7, wherein said second base portion is resiliently bendable.

10. The closure fastening device of claim 7, wherein each of said base portions is resiliently bendable.

11. The closure fastening device of claim 7, wherein at least one of said first webs is resiliently bendable.

12. The closure fastening device of claim 7, wherein at least one of said second webs is resiliently bendable.

13. The closure fastening device of claim 7, wherein at least one of said first hook portions is resiliently bendable.

14. The closure fastening device of claim 7, wherein at least one of said second hook portions is resiliently bendable.

15. The closure fastening device of claim 7, wherein said first hook portions and said second hook portions closest to each other are engageable when said channel elements are occluded.

16. The closure fastening device of claim 7, wherein one of said channel elements further comprises a flange portion adjacent to its base portion.

17. The closure fastening device of claim 7, wherein each of said channel elements further comprises a flange portion adjacent to its base portion.

18. The closure fastening device of claim 7, further comprising a film connected to said channel elements and extending between said channel elements.

19. The closure fastening device of claim 18, wherein said channel elements are positioned on the same side of said film.

20. The closure fastening device of claim, 18 wherein said channel elements are positioned on opposite sides of said film.

21. A closure fastening device consisting essentially of:

a first u-shaped channel element including a first base portion, a pair of spaced apart first webs extending from said first base portion, and first hook portions extending from each of said first webs and facing away from each other;

and a second u-shaped channel element including a second base portion, a pair of spaced apart second webs extending from said second base portion, and second hook portions nonlinearly extending from each of said second webs and facing towards each other;

said first channel element further comprising a spring element extending from its base portion to the base portion of said second channel element when said channel elements are occluded;

said channel elements being adapted to interlock by pressing said first channel element into said second channel element so that said first and said second hook portions engage at predetermined pairs of contact surfaces, one of said pairs of said contact surfaces defining a negative angle of engagement; and said channel elements establishing an open compartment defined by the interior surfaces of said first and second base portions and first and second web portions when said channel elements are occluded, each of said channel elements having substantially the same cross section along its occludable length.

22. A closure fastening device consisting essentially of:

a first u-shaped channel element including a first base portion, a pair of spaced apart first webs extending from said first base portion, and first hook portions extending from each of said first webs and facing away from each other;

and a second u-shaped channel element including a second base portion, a pair of spaced apart second webs extending from said second base portion, and second hook portions nonlinearly extending from each of said second webs and facing towards each other;

said first channel element further comprising a spring element extending from its base portion to the base portion of said second channel element when said channel elements are occluded;

said channel elements being adapted to interlock by pressing said first channel element into said second channel element so that said first and said second hook portions engage at predetermined pairs of contact surfaces, one of said pairs of said contact surfaces defining a negative angle of engagement and the other of said pairs of said contact surfaces defining either a positive or a zero angle of engagement; and said channel elements establishing an open compartment defined by the interior surfaces of said first and second base portions and first and second web portions when said channel elements are occluded;

each of said channel elements having substantially the same cross section along its occludable length.

* * * * *

UNITED STATES PATENT AND TRADEMARK OFFICE

CERTIFICATE OF CORRECTION

PATENT NO. : 4,362,198

DATED : December 7, 1982

INVENTOR(S) : Ewald A. Kamp

It is certified that error appears in the above—identified patent and that said Letters Patent is hereby corrected as shown below:

Column 6, lines 22-58, for "A container including two sidewalls and a closure fastening device consisting essentially of:

a first u-shaped channel element including a first base portion having one side connected to one of said sidewalls, a pair of spaced apart first webs extending from said first base portion, and first hook portions extending from each of said first webs and facing away from each other;

and a second u-shaped channel element including a second base portion, a pair of spaced apart second webs extending from said second base portion having one side connected to the other sidewall, and second hook portions nonlinearly extending from each of said second webs and facing towards each other;

one of said channel elements further comprising a spring element extending from its base portion to the base portion of said second channel element when said channel elements are occluded;

said bases being of sufficient width to allow at least one of them to flex during the occlusion and-opening of said fastening devices;

said channel elements being adapted to interlock by pressing said first channel element into said second channel element so that said first and said second hook portions engage at predetermined pairs of contact surfaces, one of said pairs of said contact surfaces defining a negative angle of engagement and the other of said pairs of said contact surfaces defining either a positive or a zero angle of engagement; and said channel elements establishing an open compartment defined

UNITED STATES PATENT AND TRADEMARK OFFICE

CERTIFICATE OF CORRECTION

PATENT NO. : 4,362,198

DATED : December 7, 1982

INVENTOR(S) : Ewald A. Kamp

It is certified that error appears in the above—identified patent and that said Letters Patent is hereby corrected as shown below:

by the interior surfaces of said first and second base portion and first and second web portion when said channel elements are occluded, each of said channel elements having substantially the same cross section along its occludable length." read -- A container including two sidewalls and a closure fastening device consisting essentially of:

a first u-shaped channel element including a first base portion having one side connected to one of said sidewalls, a pair of spaced apart first webs extending from said first base portion, and first hook portions extending from each of said first webs and facing away from each other;

and a second u-shaped channel element including a second base portion, a pair of spaced apart second webs extending from said second base portion having one side connected to the other sidewall, and second hook portions nonlinearly extending from each of said second webs and facing towards each other;

one of said channel elements further comprising a spring element extending from its base portion to the base portion of the other channel element when said channel elements are occluded;

said bases being of sufficient width to allow at least one of them to flex during the occlusion and opening of said fastening device;

said channel elements being adapted to interlock by pressing said first channel element into said second channel element so that said first and said second hook portions engage at predetermined pairs of contact surfaces, one of said pairs of said contact surfaces defining a negative angle of engagement and the other of said pairs of said contact surfaces defining either a positive or a zero angle of engagement; and

UNITED STATES PATENT AND TRADEMARK OFFICE

CERTIFICATE OF CORRECTION

PATENT NO. : 4,362,198

DATED : December 7, 1982

INVENTOR(S) : Ewald A. Kamp

It is certified that error appears in the above—identified patent and that said Letters Patent is hereby corrected as shown below:

said channel elements establishing an open compartment defined by the interior surfaces of said first and second base portion and first and second web portion when said channel elements are occluded;

each of said channel elements having substantially the same cross section along its occludable length.--

Column 8, lines 30-59, for "A closure fastening device consisting essentially of:

a first u-shaped channel element including a first base portion, a pair of spaced apart first webs extending from said first base portion, and first hook portions extending from each of said first webs and facing away from each other;

and a second u-shaped channel element including a second base portion, a pair of spaced apart second webs extending from said second base portion, and second hook portions nonlinearly extending from each of said second webs and facing towards each other;

said first channel element further comprising a spring element extending from its base portion to the base portion of said second channel element when said channel elements are occluded;

said channel elements being adapted to interlock by pressing said first channel element into said second channel element so that said first and said second hook portions engage at predetermined pairs of contact surfaces, one of said pairs of said contact surfaces defining a negative angle of engagement; and said channel elements establishing an open compartment defined by the interior surfaces of said first and second base portions and first and second web portions when said channel elements are occluded,

UNITED STATES PATENT AND TRADEMARK OFFICE

CERTIFICATE OF CORRECTION

DATED : December 7, 1982

INVENTOR(S) : Ewald A. Kamp

It is certified that error appears in the above—identified patent and that said Letters Patent is hereby corrected as shown below:

each of said channel elements having substantially the same cross section along its occludable length." read -- A closure fastening device consisting essentially of:

a first u-shaped channel element including a first base portion, a pair of spaced apart first webs extending from said first base portion, and first hook portions extending from each of said first webs and facing away from each other;

and a second u-shaped channel element including a second base portion, a pair of spaced apart second webs extending from said second base portion, and second hook portions nonlinearly extending from each of said second webs and facing towards each other;

said bases being of sufficient width to allow at least one of them to flex during the occlusion and opening of said fastening device;

said first channel element further comprising a spring element extending from its base portion to the base portion of said second channel element when said channel elements are occluded;

said channel elements being adapted to interlock by pressing said first channel element into said second channel element so that said first and said second hook portions engage at predetermined pairs of contact surfaces, one of said pairs of said contact surfaces defining a negative angle of engagement; and said channel elements establishing an open compartment defined by the interior surfaces of said first and second base portions and first and second web portions when said channel elements are occluded, each of said channel elements having substantially the same

UNITED STATES PATENT AND TRADEMARK OFFICE

CERTIFICATE OF CORRECTION

PATENT NO. : 4,362,198

DATED : December 7, 1982

INVENTOR(S) : Ewald A. Kamp

It is certified that error appears in the above—identified patent and that said Letters Patent is hereby corrected as shown below:

cross section along its occludable length--

Column 8, line 60 to column 10, line 11, for "A closure fastening device consisting essentially of:

a first u-shaped channel element including a first base portion, a pair of spaced apart first webs extending from said first base portion, and first hook portions extending from each of said first webs and facing away from each other;

and a second u-shaped channel element including a second base portion, a pair of spaced apart second webs extending from said second base portion, and second hook portions nonlinearly extending from each of said second webs and facing towards each other;

said first channel element further comprising a spring element extending from its base portion to the base portion of said second channel element when said channel elements are occluded;

said channel elements being adapted to interlock by pressing said first channel element into said second channel element so that said first and said second hook portions engage at predetermined pairs of contact surfaces, one of said pairs of said contact surfaces defining a negative angle of engagement and the other of said pairs of said contact surfaces defining either a positive or a zero angle of engagement; and said channel elements establishing an open compartment defined by the interior surfaces of said first and second base portions and first and second web portions when said channel elements are occluded;

each of said channel elements having substantially the same cross section along its occludable length." read --A closure It is certified that error appears in the above-identified patent and that said Letters Patent is hereby corrected as shown below:

fastening device consisting essentially of:

a first u-shaped channel element including a first base portion, a pair of spaced apart first webs extending from said first base portion, and first hook portions extending from each of said first webs and facing away from each other;

and a second u-shaped channel element including a second base portion, a pair of spaced apart second webs extending from said second base portion, and second hook portions nonlinearly extending from each of said second webs and facing towards each other;

said bases being of sufficient width to allow at least one of them to flex during the occlusion and opening of said fastening device;

said first channel element further comprising a spring element extending from its base portion to the base portion of said second channel element when said channel elements are occluded;

said channel elements being adapted to interlock by pressing said first channel element into said second channel element so that said first and said second hook portions engage at predetermined pairs of contact surfaces, one of said pairs of said contact surfaces defining a negative angle of engagement and the other of said pairs of said contact surfaces defining either a positive or a zero angle of engagement; and

UNITED STATES PATENT AND TRADEMARK OFFICE

CERTIFICATE OF CORRECTION

PATENT NO. : 4,362,198

DATED : December 7, 1982

INVENTOR(S) : Ewald A. Kamp

It is certified that error appears in the above-identified patent and that said Letters Patent is hereby corrected as shown below:

said channel elements establishing an open compartment defined by the interior surfaces of said first and second base portions and first and second web portions when said channel elements are occluded;

each of said channel elements having substantially the same cross section along its occludable length.--

Signed and Sealed this

*Twenty-second* Day of *March 1983*

[SEAL]

*Attest:*

GERALD J. MOSSINGHOFF

*Attesting Officer*

*Commissioner of Patents and Trademarks*